United States Patent [19]

Takahata et al.

[11] Patent Number: 4,525,441

[45] Date of Patent: Jun. 25, 1985

[54] MULTICOLOR ELECTROPHOTOGRAPHIC PROCESS USING $TiO_2$

[75] Inventors: Kei Takahata, Moriyama; Sadao Murasawa, Itami; Hiroshi Ichida, Shiga; Mizuho Okada; Takao Nakayama, both of Kusatsu, all of Japan

[73] Assignee: Ishihara Sangyo Kaisha, Ltd., Osaka, Japan

[21] Appl. No.: 442,973

[22] Filed: Nov. 19, 1982

[30] Foreign Application Priority Data

Nov. 27, 1981 [JP] Japan ..... 56-190168

[51] Int. Cl.[3] ..... G03G 13/01

[52] U.S. Cl. ..... 430/46; 430/42; 430/31; 430/902

[58] Field of Search ..... 430/31, 42, 46, 84, 430/902

[56] References Cited

U.S. PATENT DOCUMENTS 2,976,144 3/1961 Rose ..... 430/31 X

FOREIGN PATENT DOCUMENTS 2142656 3/1972 Fed. Rep. of Germany ..... 430/84
53-82418 7/1978 Japan ..... 430/46
55-135847 10/1980 Japan ..... 430/46
57-79946 5/1982 Japan ..... 430/84

OTHER PUBLICATIONS

Iida et al., "Temperature Dependence of Dark-Delay Properties of $TiO_2$-Polymer Dispersion Layers", Electrophotography, vol. 11, No. 2, 1971, pp. 83-89.

*Primary Examiner*—Roland E. Martin
*Attorney, Agent, or Firm*—Cushman, Darby & Cushman

[57] ABSTRACT

In practicing multi-step reproduction of color image by electrophotography using an electrophotographic photosensitive material prepared by overlaying a photosensitive layer composed mainly of titanium dioxide and a binder on an electroconductive substrate, exposure to an optical image is first carried out, then positive corona charging is carried out to form a positive electrostatic latent image and subsequently developing is carried out. Further, prior to the exposure to an optical image, negative corona charging and/or AC corona charging are additionally carried out. By this electrophotographic process effectively utilizing the photomemory effect of titanium dioxide, multi-color images can be produced, and an image having good contrast can be reproduced easily and stably.

16 Claims, 8 Drawing Figures

MULTICOLOR ELECTROPHOTOGRAPHIC PROCESS USING $TiO_2$

BACKGROUND OF THE INVENTION

1. Field of the Invention

This invention relates to an electrophotographic process, and more particularly, to an electrophoto-graphic process for producing multi-color images by utilizing the photomemory effect of a photosensitive material in which titanium dioxide is used.

2. Description of the Prior Art

As electrophotographic process, the so-called Carlson's process has been best known hitherto. The image-forming step of this process fundamentally comprises a charging step for giving electric charge to the surface of photosensitive layer, a subsequent exposing step for exposing the photosensitive layer to an optical image, thereby forming an electrostatic latent image, and then a developing step for converting the electrostatic latent image to a toner image. From the practical point of view, this process is roughly classified into the so-called PPC method involving the step of transferring a toner image onto usual paper and the so-called CPC method in which a toner image is formed on a photosensitive material.

This Carlson's process is markedly distributed currently, particularly in the field of copying systems for monochromatic images. At the same time, application of this process to color copying or color printing for producing a multi-color image by successively repeating the step of reproduction of color images is also being developed. However, many problems must be solved before its practical application. For example, the photosensitivity at the time of exposure tends to be markedly affected by the charging conditions before the exposure. Further, the dark decay of surface charge in the period from charging to development cannot be avoided. Particularly, the dark decay in the nonexposed areas in the course of exposure is quite difficult to avoid because of the nature of image-producing system, and this limits the production of a multi-color image by combining the charging step by a scanning method with the step of exposing to an optical image in the static state or by carrying out the exposure to an optical image by scanning of laser light requiring a long period of time for the exposure. Further, when a film original is contacted with a photosensitive layer and exposed to an optical image, disturbance readily takes place in the electrostatic latent image at the time of peeling off the film after the exposure, so that the reduction of the quality of image is unavoidable. Further, if a photosensitive material containing titanium dioxide as photoconductive material is employed in Carlson's process, an image having high contrast is difficult to produce in contrast with good continuous degradation of the image.

The present inventors have conducted various studies with the aim of solving the above-mentioned problems, in the course of which the inventors have examined the application of the so-called persistent conductivity phenomenon, i.e. the formation of an electrostatic latent image by utilizing the photomemory effect of a photoconductive material. In case of producing an electrostatic latent image by using an N-type semi-conductor, such as titanium dioxide, as the photoconductive material, it is conventional to apply, first, negative charging and then exposure to an optical image, as is well known.

However, in the above-mentioned system utilizing the photomemory effect wherein the charging is carried out after the exposure to an optical image, the photomemory is readily erased and an electrostatic latent image is substantially difficult to form if the photosensitive material using titanium dioxide is first exposed to an optical image and then negative charging is carried out. Nevertheless, it has been surprisingly and unexpectedly found that if positive charging is carried out after the exposure to an optical image an electrostatic latent image corresponding to the exposure to an optical image can be formed without the photomemory being erased. Based on this finding, the inventors have conducted additional studies to accomplish this invention.

SUMMARY OF THE INVENTION

This invention is based on the following findings: (1) If an electrophotographic photosensitive material wherein titanium dioxide is used is exposed to an optical image and then subjected to positive corona discharge, an outstandingly sharp photomemory effect is exhibited, and an electrostatic latent image having a positive charge corresponding to the quantity of exposure to an optical image can readily be formed. (2) By carrying out negative corona charging and/or AC corona charging prior to the exposure to an optical image, the erasion of the residual photomemory on the photosensitive material can be accelerated, and the photomemory performance can be recovered rapidly. (3) By repeating said image-producing step several times, a multi-color image having good contrast can be reproduced easily and stably with an electrophotographic photosensitive material wherein titanium dioxide is used as the photoconductive material.

The object of this invention is to provide a color electrophotographic process by which the photomemory effect of titanium dioxide can be utilized effectively.

This invention provides an electrophotographic process, characterized by forming a multi-color image by conducting successively the first image-producing process which comprises exposing to an optical image a photosensitive material consisting of an electroconductive substrate having overlaid thereto a photosensitive layer composed mainly of titanium dioxide and a binder, said photosensitive material having been subjected or not subjected to negative corona discharge or AC corona discharge or both of them, prior to said exposure to an optical image, thereafter subjecting the exposed photosensitive material to positive corona discharge to form a positive electrostatic latent image and subsequently developing it to form a toner image and the second and following image-producing processes which comprise successively subjecting the product in the first process to negative corona discharge, AC corona discharge or both of them, to exposure to an optical image, to positive corona discharge and to development, to form a toner image.

BRIEF DESCRIPTION OF THE ACCOMPANYING DRAWINGS

In the accompanying drawings,

FIG. 1 is a figure illustrating the structure of the photosensitive material used in this invention, FIG. 2 is a figure illustrating the negative corona charging step, FIG. 3 is a figure illustrating the AC corona charging step, FIG. 4 is a figure illustrating the step of exposure to an optical image, FIG. 5 is a figure illustrating the positive corona charging step, FIG. 6 is a figure illustrating the developing step, FIG. 7 is a figure illustrating the reversal-liquid electrophoretic developing step, and FIG. 8 is a graph for showing the relation between the surface potential of photosensitive material and the positive corona discharge voltage in order to explain the effect of the process of this invention.

In FIG. 1, the photosensitive material 3 used in this invention is constructed from a photosensitive layer 1 and an electroconductive substrate. FIGS. 2–7 illustrate a set of the steps required for image-production in this invention. A multi-color image can be produced by repeating the image-producing steps.

FIG. 2 illustrates a step of carrying out negative corona charging, wherein 4 is a negative corona charging device. It is also possible to carry out the AC corona charging shown in FIG. 3, in place of said negative corona charging. In FIG. 3, 5 refers to an AC corona charging device. FIG. 4 illustrates the step of exposure to an optical image, wherein 6 is an optical image pattern. In this step, in the exposed areas, the electroconductivity of the photosensitive layer, and the nonexposed areas are kept insulating. As a result thereof, if the surface of a photosensitive layer is negatively charged by negative corona charging before the exposure to an optical image, the electric charge decays in the exposed areas and is maintained without decay in the nonexposed areas.

FIG. 5 illustrates the positive corona charging step, wherein 7 is a positive corona charging device. In this case, the areas exposed to an optical image are kept electroconductive by the photomemory effect, so that they are not charged positively or are charged only to a lower potential than in the areas not exposed to an optical image even if they are subjected to positive corona charging. On the other hand, the nonexposed areas are charged to a high potential by positive corona charging.

DETAILED DESCRIPTION OF THE INVENTION

Figure 1:
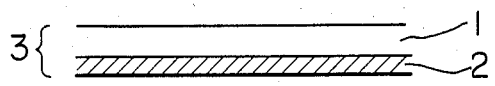
Figure 2:
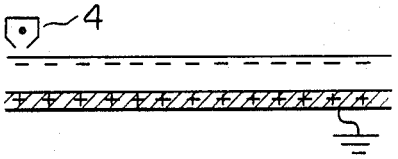
Figure 3:
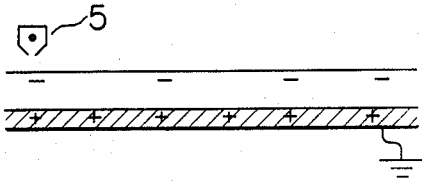
Figure 4:
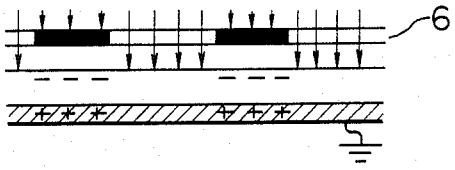
Figure 5:
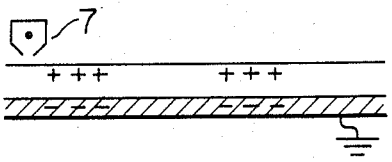
Figure 6:
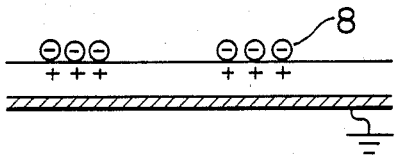
FIG. 6 illustrates the developing step in the case that the development is carried out with a toner particle 8 having negative charge. In this case, the toner particle adheres to the nonexposed areas, so that a positive image is obtained with regard to the original image.
Figure 7:
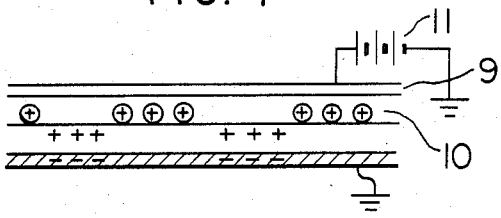
FIG. 7 illustrates a reversal-liquid electrophoretic developing step wherein development is carried out with a positively charged toner particle 10 while applying developing bias-electric voltage to the developing electrode. In this figure, 9 is a developing electrode, and 11 is an electric source for the developing electrode.

The electrophotographic photosensitive material used in the process of this invention is prepared by overlaying, onto an electroconductive substrate, a photoconductive sensitive layer composed mainly of titanium dioxide and a binder. In this case, (1) as said titanium dioxide used, there may be used products of various processes conventionally used in electrophotography, among which those having a high purity and a rutile type crystal form are more preferable. (2) As said binder used for dispersing titanium dioxide and constructing a photoconductive sensitive layer, various substances may be used, among which those having a high electrical insulating property and a good film-formability are preferable. For example, synthetic resins such as polyvinyl resin, acrylic resin, alkyd resin, polyester resin and the like may be used alone or in admixture of two or more. (3) As said electroconductive substrate, there may be used various substances, such as metal plates, metal-deposited paper and film, and paper and film coated with an electroconductive layer containing electroconductive resins or electroconductive powders, and the like. The proportion of said titanium dioxide to said binder, both constituting the photosensitive layer, may be selected from a broad range. As expressed in terms of volume ratio, it is usually in the range of 25:75 to 65:35, and more preferably 30:70 to 60:40.

In addition to said titanium dioxide and said binder, the photosensitive layer of this invention may optionally contain, as its constituents, minor components such as dyes, electron acceptive materials, electron donative materials and the like. For example, addition of dye is particularly effective when a photosensitive material exhibiting a photomemory effect over a wide wavelength range is required. Said dye may be selected from sensitizing dyes such as xanthene dyes, methine dyes, triphenylmethane dyes, diphenylmethane dyes, azine dyes, thiazine dyes, oxazine dyes and the like. Further, it may also be selected from chargability-improvers such as organic acids, organic acid anhydrides, metallic soaps, phenols, silane couplers, titanate couplers, amines and the like.

As the light source used in the exposing step of this invention, those involving a light in the intrinsic absorption wave-length range of titanium dioxide (ca. 410 nm) are most effective from the viewpoint of photomemory effect. However, when an appropriate sensitizing dye is used, the photomemory effect can be exhibited even if the light used is out of the above-mentioned intrinsic absorption wave-length range. Therefore, it is preferable to select a light having a wave-length well meeting the spectral sensitivity characteristics of the photomemory effect of the photosensitive layer. For example, tungsten light source, various metal halide light sources, xenone light source, fluorescent lamp, various laser light sources and the like are usually employed either alone or in combination. When a color copy is made from color original image, it is usually necessary to carry out the exposure to each of three to four separated lights (blue, yellow, red and white). However, when color printing is carried out by contact exposure using a three- or four-color separation film prepared by using lith film as color original image, all the sets of exposure can be carried out with only one light source containing a light having a wave-length in the photosensitivity region of photosensitive material. Further, when a color separation lith film is used in the exposing step as will be mentioned in Examples which appear hereinafter, said film is placed on the surface of titanium dioxide-containing photosensitive layer so as to contact with the latter, whereby the dot gain or dot loss of dot images at boundary between the exposed area and the nonexposed area can be avoided.

In the process of this invention, the positive corona charging after the exposure to an optical image is carried out at such a voltage for such a period of time that a positive electric charge is given to the areas not exposed to an optical image of photosensitive layer and a sufficient electroconductivity is maintained in the exposed areas owing to memory effect, whereby a positive surface potential great enough to form a positively charged electrostatic latent image corresponding to the optical image is given the photosensitive layer. As the corona charging device, those having various types of structures may be used.

In the process of this invention, the development after the positive corona charging can be carried out by various developing processes such as wet-developing process or dry-developing process, and particularly, when it is conducted by a liquid development method, which is the so-called liquid-electrophoretic development method, is particularly preferable in that it easily reproduces a high quality image. According to this method, liquid developers composed of positively or negatively charged toners of cyan color, magenta color, yellow color and black color are used corresponding to the color separation exposure of each set. That is, for example, three or four colors of the toners are superposed on the surface of photosensitive layer to form a multi-color image.

According to the process of this invention, the dark decay of surface charge in the period from charging to exposure can be avoided, unlike Carlson's process. Therefore, it is particularly useful for applying electrophotography to color copying or color printing by using a multi-color image or a color separation film in which the image areas and the nonexposed areas are clearly distinguishable, such as dot image, as original image. If the development is carried out on a positively charged electrostatic latent image by a reversal-liquid electrophoretic developing method using a positively charged toner, an image having a better contrast can be obtained with a less fog. That is, since in the process of this invention the resulting electrostatic latent image hardly has a surface potential in the exposed areas of photosensitive layer and has a sufficiently high positive charge in the nonexposed areas, development is carried out with a toner having positive charge while applying, to the developing electrode, a developing bias-voltage lower than the surface potential of nonexposed areas. By this procedure, the nonexposed areas can be kept free from fog, because the toner hardly adheres to the nonexposed areas due to the repulsion between the positive charge of toner and the positive surface potential of photosensitive layer. On the other hand, since the exposed areas hardly have surface potential, the toner adheres to the surface of photosensitive material to form a toner image in the exposed areas due to the repulsion between the developing bias voltage and positive charge of toner. Color density of image can easily be controlled by the applied developing bias voltage, so that a stable, good image can be reproduced.

In the process of this invention, a multicolor image is produced by repeating plural sets of the image-producing process. In the first reproduction step of a color image, a photosensitive material which has sufficiently been adapted to light and has no residual photomemory effect can be used, so that it is not always necessary to carry out the negative corona charging and/or the AC corona charging before the exposure to an optical image. However, even in the case of such photosensitive materials, a more desirable results can be obtained in many cases with regard to positive corona chargeability of nonexposed areas, by previously carrying out the above-mentioned corona charging. In the second and following steps, negative corona charging or AC corona charging is carried out prior to the exposure to an optical image of each step, in order to accelerate the erasure of the photomemory in the preceding step. Accordingly, in any case, the voltage and period of negative corona charging and/or AC corona charging may have values great enough to erase the photomemory effect of the preceding step and to accelerate the recovery of photomemory.

Unlike Carlson's process, the process of this invention enables the dark decay of charging potential to be avoided in the course of reproducing an image and the disturbance of the electrostatic latent image at the time of exposing the photosensitive layer in contact with the original image to light, and it easily and stably reproduces a multi-color image having good contrast by using a titanium dioxide-containing photosensitive material. Thus, the process of this invention can be applied to color copying, color printing and various color electrophotographic recordings.

DESCRIPTION OF PREFERRED EMBODIMENTS OF THE INVENTION

EXAMPLE 1

An electrohpotographic titanium dioxide pigment (hereinafter, simply referred to as "$TiO_2$") was prepared by dissolving titanium tetrachloride (special grade chemical) in water, thermally hydrolyzing the resulting aqueous solution to obtain hydrated titanium oxide, adding 1 mole % of ZnO to the hydrated titanium oxide to dope the latter and then calcining it in an electric oven at 800° C. for 2 hours.

Using this $TiO_2$, a coating mixture having the following composition for forming a photosensitive layer was prepared:

| | |
|---|---|
| $TiO_2$ | 8 g |
| Acrylic resin binder (NISHOKU ARROW CHEMICAL CO. LTD.: AROSET 5804xC) | 6.4 g |
| Dibromofluorescene (reagent) | 2.4 mg |
| Cyanine dye (JAPAN RESEARCH INSTITUTE FOR PHOTOSENSITIZING DYES CO., LTD.: NK-1194) | 2.4 mg |
| p-tert-Butylcatechol (reagent) (10 g/liter solution in xylene) | 0.17 ml |
| Zinc naphthenate (reagent) (a solution containing 8% of Zn) | 0.3 ml |
| Xylene | 6.7 ml |

A coating mixture was prepared by introducing this mixture into a bottle having a capacity of 70 ml together with about 40 g of glass beads having a diameter of 1–2 mm, shaking them for 20 minutes by means of RED DEVIL Paint Conditioner and then separating the glass beads.

The coating mixture was coated on an aluminum foil by means of a doctor applicator of 30μ and dried at 100° C. for 5 minutes to obtain a photosensitive material having a dry film thickness of 17μ. It was adapted to dark for 48 hours and then used for the production of an image.

Characteristics of this photosensitive material were investigated by means of Electric Paper Analyzer SP-428 type manufactured by KAWAGUCHI ELECTRIC WORK CO., LTD. The results obtained will be explained with reference to FIG. 8.

Figure 8:
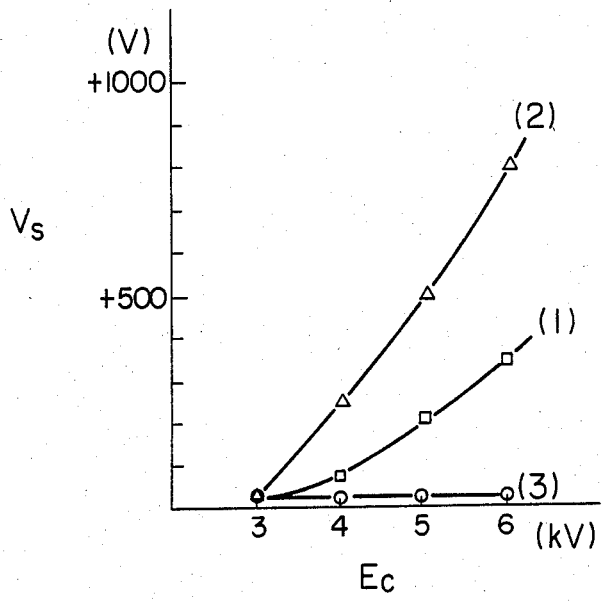

In FIG. 8, the abscissa means the positive corona discharging voltage ($E_c$: Kilovolts) applied to the corona charging device, and the ordinate means the surface potential ($V_s$: volts) of photosensitive material. The charging was carried out for 20 seconds by dynamic method. In FIG. 1, curve (1) refers to the charging characteristics at the time of carrying out only the positive corona charging. Curve (2) refers to a charging curve at the time of first carrying out the negative charging and then carrying out the positive charging. By comparing curve (2) with curve (1), it is understandable that the positive charging can be carried out more easily after the negative charging has first been carried out. Curve (3) refers to the charging characteristics at the time of first carrying out the negative charging, then carrying out the exposure and finally carrying out the positive charging. In this case, the photosensitive material was hardly charged. In this case, the exposure was carried out by using a green color light which had been derived from a white color light of tungsten lamp of 1,000 luxes by a green-colored interference filter, and the exposure time was 2 seconds. When the exposed photosensitive material was successively subjected to the same negative corona charging and positive corona charging as in curve (2), there was obtained a curve entirely the same as (2).

Next, using this photosensitive material, a color image was produced in the following manner:

(1) As the original image, there was used a three-color separated negative film for color printing prepared from lith film. Previously, position marks had been put on the photosensitive material and the original image film in order to prevent absence of color registration at the time of superposing the original image film on the photosensitive layer. The surface of the photosensitive layer was first subjected to AC corona charging by applying a voltage of 4.3 KV to the corona charging device, after which a separation negative film for yellow color image was superposed on the photosensitive layer and exposed to a white light of tungsten light source. The quantity of light-exposure was 300 luxsecond. Then, the separation negative film was taken off and the photosensitive layer was positively charged by applying a voltage of 6 KV to the corona charging device, until the surface potential of the nonexposed areas reached saturation. Immediately thereafter, it was developed with a yellow-colored, positively charged, liquid toner while applying a positive developing bias-voltage of 200 V, whereby a yellow-colored positive image having good quality was obtained.

(2) Subsequently, the photosensitive material having an image obtained in above (1) was subjected to negative corona charging (the applied voltage: −6 KV), and thereafter, subjected, in the same manner as in above (1), to exposure and positive corona charging using a separation negative film for a magenta color image and then developed with a magneta-colored, positively charged toner.

(3) Furthermore, the photosensitive material having an image obtained in above (2) was subjected to negative corona charging (the applied voltage: −6 KV), and thereafter, subjected, in the same manner as in above (1), to exposure and positive corona charging using a separation negative film for a cyan color image and then developed with a cyan-colored, positively charged toner, to obtain a three-color image having a good contrast.

The same procedures as in above (1), (2) and (3) were repeated, except that negative corona charging was conducted in place of the positive corona charging after each exposure to form a print. However, there was formed no static latent image corresponding to the density of image, and the record obtained was inferior in print quality.

EXAMPLE 2

The same photosensitive material as in Example 1 was exposed to an optical image by using a color slide film and a slide projector. Since the light source was a white light, the slide projector was so modified that an arbitrarily selected filter of blue, green or red color could be attached to the position close to the projecting hole of slide projector. A step of negative corona charging, a step of exposure to an optical image in the state that the blue filter was attached to the projector, a step of positive corona charging, a step of development with negatively charged yellow colored toner, a step of negative corona charging, a step of exposure to an optical image in the state that the green filter was attached to projector, a step of positive corona charging, a step of development with negatively charged magenta colored toner, a step of negative corona charging, a step of exposure to an optical image in the state that the red filter was attached to the projector, a step of positive corona charging and a step of development with negatively charged cyan color toner were successively carried out. As a result, a good three-color image was obtained.

What is claimed is:

1. An electrophotographic process, characterized by forming a multiple color image by successively carrying out the first color image-reproducing process which comprises exposing, to an optical image, an electrophotographic photosensitive material having a photoconductive, sensitive layer consisting essentially of titanium dioxide and a binder on an electroconductive substrate, then carrying out a positive corona charging to form a positive electrostatic latent image and thereafter carrying out developing to form a toner image, and the second and following color image-reproducing processes which comprise successively carrying out negative corona charging, AC corona charging or both of them, exposure to an optical image, positive corona charging and development to form a toner image.

2. An electrophotographic process, characterized by forming a multiple color image by successively carrying out color image-reproducing process which comprises subjecting an electrophotographic photosensitive material having a photoconductive, sensitive layer consisting essentially of titanium dioxide and a binder on an electroconductive substrate to negative corona charging, AC corona charging or both of them, then carrying out exposure to an optical image, then carrying out positive corona charging to form a positive electrostatic latent image, and thereafter developing it to form a toner image.

3. An electrophotographic process according to claim 1, wherein said exposure to an optical image is carried out by using film originals.

4. An electrophotographic process according to claim 1, wherein said exposure to an optical image is carried out by using color separation films for color printing.

5. An electrophotographic process according to claim 1, wherein said exposure to an optical image is carried out by contacting said film originals with the surface of the photosensitive material.

6. An electrophotographic process according to claim 1, wherein said developing is carried out by a liquid electrophoretic developing method.

7. An electrophotographic process according to claim 6, wherein said developing is carried out by a reversal-liquid electrophoretic developing method.

8. An electrophotographic process according to claim 1, wherein said photosensitive layer composed of titanium dioxide and a binder has a composition of 25:75 to 65:35, as expressed by volume ratio of titanium dioxide to binder.

9. An electrophotographic process according to claim 1, wherein at least three steps of said color image-reproducing steps are successively carried out.

10. An electrophotographic process according to claim 2, wherein said exposure to an optical image is carried out by using film originals.

11. An electrophotographic process according to claim 2, wherein said exposure to an optical image is carried out by using color separation films for color printing.

12. An electrophotographic process according to claim 2, wherein said exposure to an optical image is carried out by contacting said film originals with the surface of the photosensitive material.

13. An electrophotographic process according to claim 2, wherein said developing is carried out by a liquid electrophoretic developing method.

14. An electrophotographic process according to claim 13, wherein said developing is carried out by a reversal-liquid electrophoretic developing method.

15. An electrophotographic process according to claim 2, wherein said photosensitive layer cmposed of titanium dioxide and a binder has a composition of 25:75 to 65:35, as expressed by volume ratio of titanium dioxide to binder.

16. An electrophotographic process according to claim 2, wherein at least three steps of said color image-reproducing steps are successively carried out.

* * * * *